US005934212A

United States Patent [19]

Gitlin et al.

[11] Patent Number: 5,934,212

[45] Date of Patent: Aug. 10, 1999

[54] TWO PART SEWING SYSTEM FOR LARGE WORK PIECES

[76] Inventors: Harris M Gitlin, 1646 Quincy Pl., Honolulu, Hi. 96816; Robert E. Gitlin, 398 W. 2900 S., Price, Utah 84501

[21] Appl. No.: 08/923,630

[22] Filed: Sep. 4, 1997

[51] Int. Cl.[6] ..... D05B 19/00; D05B 69/00

[52] U.S. Cl. ..... 112/470.01; 112/220; 112/223; 112/254

[58] Field of Search ..... 112/470.01, 220, 112/221, 275, 277, 304, 320, 7, 168, 223, 80.23, 254

[56] References Cited

U.S. PATENT DOCUMENTS

| | | | |
|---|---|---|---|
| 4,633,794 | 1/1987 | Kato | 112/470.01 X |
| 4,991,080 | 2/1991 | Hager | 112/275 X |
| 5,322,027 | 6/1994 | Hashiride et al. | 112/220 |
| 5,660,129 | 8/1997 | Murata et al. | 112/220 X |

*Primary Examiner*—Peter Nerbun

*Attorney, Agent, or Firm*—Rodger H. Flagg

[57] ABSTRACT

This invention relates to an improved automatic sewing machine apparatus for sewing large articles, in lock-stitch or chain-stitch, employing two completely different upper and lower sewing mechanisms which are separately powered, wherein there is no continuous mechanical, electrical, hydraulic or other fixed connection between the upper and lower sewing mechanisms required. An open notched needle has a notch opening disposed near the needle end, the notch opening engages the needle thread, and carries the needle thread through the sewing material, and then leaves a loop extending through the sewing material as the notched needle raises above the sewing material. The notch opening in the needle is rethreaded during each cyclic, reciprocating actuation of the notched needle. A looper having two forked arms passes the thread loop around the bobbin case. The position of the open notched needle determines the timing of the looper actuation. The open notched needle position is sensed through the sewing material. The sewing material is advanced by pinching the material between adjacent wheels and rollers, or by a rotating belt.

27 Claims, 7 Drawing Sheets

TWO PART SEWING SYSTEM FOR LARGE WORK PIECES

BACKGROUND OF THE INVENTION

This invention relates to an improved automatic sewing machine for sewing large articles, in lock-stitch or chain-stitch, employing two completely different upper and lower mechanisms which are separately powered, wherein there is no continuous mechanical, electrical, hydraulic or other fixed connection between the upper and lower mechanisms required. An open notched needle carries the thread loop through the sewing material, and leaves a loop extending through the material as the needle retracts. An open notch in the needle enables the needle to be re-threaded during each stroke of the needle. A rotating bobbin assembly is provided with a unique bobbin case support means. The bobbin assembly dispenses bobbin thread to create a lock-stitch. A looper having two forked arms passes the needle thread around the bobbin case. The position of the needle determines the timing of the looper actuation. The needle position is sensed through the material being sewn. The material is advanced by pinching the material between adjacent wheels and rollers, or by rotating belts.

DESCRIPTION OF THE PRIOR ART

U.S. Pat. No. 3,207,107 issuing to J. Castany Ferre on Sep. 21, 1965 discloses a notched needle utilizing movable pincers to clamp the needle thread temporarily during the unthreading and subsequent threading of the needle.

U.S. Pat. No. 3,373,706 issuing to G. Armstead, Jr. on Mar. 19, 1968 discloses an overlapping chain stitch for an over-edge chain stitch seam, comprising two separate sequences of aligned stitches.

U.S. Pat. No. 3,386,401 issuing to R. Johnson on Jun. 4, 1968, discloses a sewing machine having a needle and loop taker which are capable of being actuated in untimed relation.

U.S. Pat. No. 3,476,067 issuing to R. Johnson on Nov. 4, 1969, discloses a sewing machine with needle and loop taker operable not in a predictably timed relationship.

U.S. Pat. No. 3,515,080 issuing to Ramsey on Jun. 2, 1970, discloses an electronically geared sewing machine having separate needle and bobbin drive units that are synchronized with stepper motors, eliminating the mechanical connection between the needle and the bobbin, to improve efficiency, reliability and versatility, and enabling multiple sewing heads which are electronically geared.

U.S. Pat. No. 3,875,489 issuing to J. Von Brimer on Apr. 1, 1975 discloses a linear self synchronous electromagnetic drive system for sewing machines, having a first needle drive member and a second bobbin drive member. The second bobbin drive member has a magnetic armature driven by a linear actuator responsive to a control signal from the first needle drive member. An amplifier sends amplified pulses from a magnet and pickup coil on the first needle drive member to the windings distributed in the bobbin carrier to synchronize the movement of the bobbin and the needle.

U.S. Pat. No. 4,658,741 issuing to F. Jehle, et al., on Apr. 21, 1987 discloses a method and apparatus for determining and regulating the amount of advance of a plurality of material plies. A pulse generator scans the individual plies at two locations, and pulses from a pulse generator are summed to achieve a desirable feed for each ply.

U.S. Pat. No. 4,690,081 issuing to Castagna et al., n Sep. 1, 1987 discloses a sewing machine having separate needle drive and bobbin drive synchronized by a hydraulic pulse generator to provide hydraulic control of a plurality of sewing devices.

U.S. Pat. No. 4,712,495 issuing to J. Jagieski on Dec. 15, 1987 discloses a chain stitch blind stitch sewing machine having a closed eye, arcuate needle.

U.S. Pat. No. 4,848,252 issuing to M. Ciucani on Jul. 18, 1989 discloses a sewing machine having a curved needle which operates in combination with a crochet hook to produce a stitch. A needle pressure foot assembly intermittently feeds the two edges of the material being sewn, while a feed dog acts in combination with a second pressure foot to crimp the edge of the material.

U.S. Pat. No. 5,088,429 issuing to T. Kanegae on Feb. 18, 1992 discloses a sewing machine having individually driving needle bar and looper, utilizing photoelectric cells and interrupters mounted on the motor shafts of the needle drive motor and the looper drive motor to initialize the position of the looper in a predetermined starting position.

U.S. Pat. No. 5,158,826 issuing to T. Hirose of Dec. 8, 1992 discloses a sewing machine having an inclined needle axis to increase the length of thread loaded on the bobbin.

U.S. Pat. No. 5,207,169 issuing to C. Mario on May 4, 1993 discloses a machine for stitching articles, such as leather, having inner and outer presser feet which are moved in timed relation with the motion of the needle. The needle cooperates with a rotary hook connected with a spool of stitching thread. The needle extends in an arc with oscillatory and translatory longitudinal to-and-fro motion.

U.S. Pat. No. 5,458,075 issuing to W. Tice et al., on Oct. 17, 1995 discloses a sewing machine which is electrically geared to position the bobbin with the motion of the needle with the use of positional information. Multiple sewing heads may be connected to a controller to electronically control the needle and bobbin of each individual sewing head.

U.S. Pat. No. 5,474,001 issuing to I. Tajima et al., on Dec. 12, 1995 discloses a multi-head embroidery machine having a driving source independent of the other driving mechanisms, with a control device to synchronously drive the driving source and the driving mechanisms.

The prior art cited above does not disclose nor make obvious a sewing machine in which the upper sewing mechanism incorporating the needle drive means is separately powered from the lower sewing mechanism bobbin assembly, without a direct mechanical, electrical or hydraulic link between the upper sewing mechanism and the lower sewing mechanism to synchronize the actuation of the needle drive means and the bobbin assembly. Nor does the prior art disclose the use of an open notched needle to pass sewing thread through the sewing material on the down stroke, while releasing the sewing thread on the upstroke, to form a loop of sufficient size for the loopers to engage and enlarge the loop around the bobbin case on each cyclic, reciprocating actuation of the notched needle.

Therefore, one object of this invention is to provide a new and innovative sewing machine having independent operation of the upper and lower sewing mechanisms.

Another object of this invention is to provide a sewing machine adapted for sewing large work pieces.

Yet another object of this invention is to provide multiple independent sewing machines for simultaneously sewing a single large work piece.

Still another object of this invention is to provide a sewing machine having an open notched needle which engages the sewing thread on the down stroke, and disengages the sewing thread beneath the sewing material on the upstroke to form a loop that is passed around the bobbin case by a pair of loopers of a size to pass the bobbin assembly therethrough.

SUMMARY OF THE INVENTION

This invention relates to an improved automatic sewing machine apparatus for sewing large articles, in lock-stitch or chain-stitch, employing two completely different upper and lower sewing machine mechanisms which are separately powered, wherein there is no continuous mechanical, electrical, hydraulic or other fixed connection between the upper and lower sewing machine mechanisms required. A notched needle carries the needle thread through the sewing material, and leaves a loop extending beneath the sewing material as the notched needle is raised above the sewing material. The notched needle is rethreaded during each cyclic, reciprocating actuation of the needle. A rotating bobbin assembly passes bobbin thread through the loop formed beneath the sewing material. A looper having forked arms passes the looped thread around the bobbin assembly. The position of the notched needle determines the timing of the looper actuation. The notched needle position is sensed through the sewing material. The sewing material is advanced by pinching the material between adjacent wheels and rollers, or by a rotating belt.

DESCRIPTION OF THE DRAWINGS

The above mentioned and other features and objects of this invention and the manner of attaining them will become more apparent and the invention itself will be best understood by reference to the following description of the invention taken in conjunction with the accompanying drawings, wherein.

DESCRIPTION OF THE PREFERRED EMBODIMENT

The sewing material 6 may be any cloth, canvas, fabric, sheet, paper, plastic, leather, or combination of these materials, or any other flexible material capable of being sewn together by the sewing machine apparatus disclosed herein.

As shown in FIG. 1 through FIG. 26, this sewing machine apparatus A is capable of sewing large widths of sewing material 6 without interference from posts, columns or other supports extending between upper sewing mechanism B and lower sewing mechanism C of this sewing machine apparatus A. The upper sewing mechanism B of this sewing machine apparatus A may be supported from the ceiling or other independent support structure, while the lower sewing mechanism C of this sewing machine apparatus A may be supported from the floor, wall or other support structure which is independent of the support structure of the upper sewing mechanism B. This enables the user to stitch large sewing material 6, without the sewing material 6 bunching up against conventional upright supports connecting the upper and lower portions of conventional sewing machines. While this sewing machine apparatus A has been primarily designed for use in industrial applications, it is also within the scope of this disclosure to adapt this sewing machine apparatus A for conventional sewing, such as for home use.

Figure 1:
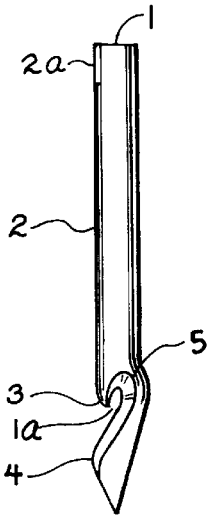
FIG. 1 is a side elevation view of the notched needle having a notch in proximity to its distal end.

Referring now to FIG. 1, the open notched needle 1 is shown having a shank 2 which is preferably rounded at 3 to aid in guiding the upper thread into a notch opening 1*a* as the needle 1 is raised towards top dead center of the linear cyclic, reciprocating actuation F. The upper portion of the notched needle shank 2 preferably has an alignment means 2*a,* such as a flattened portion, key-way, detent or protrusion to orient the notched needle 1 in the upper sewing mechanism B of the sewing machine apparatus A. Other cross-sectional shapes of shank 2 may also be used, such as oval or multi-sided to suit releasable securement of the notched needle 1 to the upper sewing mechanism B of the sewing machine apparatus A.

Alternately, the notched needle 1 may be manually oriented by the operator prior to use. The upper sewing machine mechanism B is adapted to provide linear, cyclic reciprocating actuation F to the notched needle 1, in a manner well known in the sewing machine art. Any known means to provide linear, cyclic reciprocating motion F to the notched needle 1 is intended to fall within the scope of this invention, and thus is not further detailed herein.

The open notched needle 1 has a notch opening 1*a* which inclines upwardly to capture the needle thread 13 during each downward thrust of the linear, cyclic reciprocating actuation F of the sewing needle 1. The notched opening 1*a* further allows the open notched needle 1 to doff the needle sewing thread 13 beneath the sewing material 6 on each upward thrust of the linear, cyclic reciprocating actuation F of the sewing needle 1.

Figure 2:
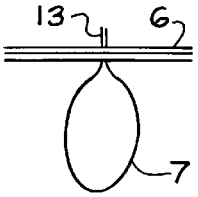
FIG. 2 is a side view of the sewing material, showing a loop extending beneath the sewing material.

The open notched needle 1 preferably includes an arcuate portion 4 which extends below the notch opening 1*a* towards the distal end of the notched needle 1. The arcuate portion 4 serves to position the needle thread 13 for engagement in the notched opening 1*a* during the downward thrust of the cyclic reciprocating actuation of the sewing needle 1. The arcuate portion 4 further serves to position the needle thread 13 into a loop 7 as shown in FIG. 2, when the notched needle 1 is raised above the sewing material 6 during the upward thrust of the notched needle 1. The arcuate portion 4 also serves to reduce the snagging of the sewing material 6 as the needle 1 is cyclically reciprocated in relation to the sewing material 6.

Preferably, the open notched needle 1 has a widened, rounded shank portion 5 in proximity to the notch opening 1*a* to strengthen the notched needle 1 during its linear, cyclic reciprocating actuation F, and to provide a larger radius for thread passage through and around the notch opening 1*a* as the needle descends, reducing the potential to fray the thread. Surrounding the open notch 1*a* from above is a small radius in-curve to the notch opening 1*a* from the smooth surface of the notched needle shank 2, to aid thread entrance into the open notch 1*a* as the open notch needle 1 rises.

Figure 3:
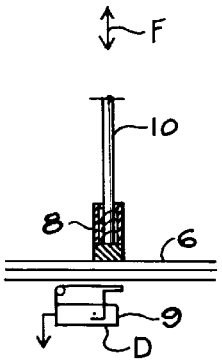
FIG. 3 is a side view of a switch assembly located beneath the sewing material which is responsive to cyclic magnetic or electromagnetic influence from a magnet on a shaft located above the sewing material.

FIG. 3 through FIG. 6 show alternate embodiments of a lower unit sensing means D to coordinate the movement of the needle 1, with complimentary movement of the looper arms 32 as the notched needle passes through the sewing material 6. As shown in FIG. 3, a magnet means 8 is located above the sewing material 6. The magnet means 8 may be any suitable magnet or electromagnet known in the art. The magnet means 8 may be used to bias a suitable magnetic switch 9 located below the sewing material 6. Looper arms 32 are moved responsive to actuation of the magnetic switch 9. This is accomplished through the material without any direct connection between the upper and lower sewing machine mechanisms B, C. A separate shaft 10 may be used in cyclic reciprocating actuation to bias the magnet means 8 in harmony with movement of the notched needle 1, to control the cyclic actuation of magnetic switch means 9, or as an electromagnet to maintain a fixed, selected position for the magnet means 8.

Figure 4:
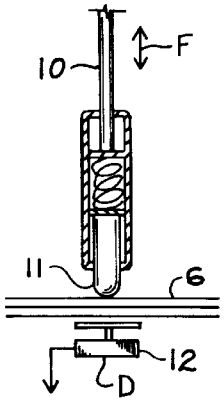
FIG. 4 is an alternate embodiment of FIG. 3, wherein a sensor located beneath the sewing material is responsive to cyclic movement of a pressure plunger located above the sewing material.

As shown in FIG. 4, the selected actuating means D may include a separate shaft 10, which may incorporate a pressure plunger 11 located above the sewing material 6, with a suitable sensor means 12 located below the sewing material 6. The sensor means 12 is responsive to movement of the pressure plunger 11, to coordinate movement of the looper arms 32 in response to movement of the notched needle 1 through the sewing material 6.

Figure 5:
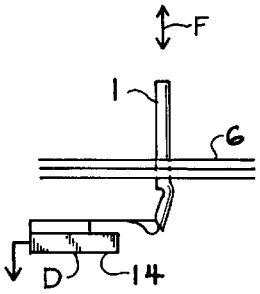
FIG. 5 is an alternate embodiment of FIG. 3, wherein a switch located below the sewing material is responsive to the needle passing through the sewing material or a low voltage electric current passing through the needle.

Alternately, as shown in FIG. 5, the lower unit sensing means D may include an electrical switch means 14 located beneath the sewing material 6. Electrical switch means 14 is biased by the cyclic reciprocating movement of the notched needle 1 as it passes through the sewing material 6. The electrical switch means 14 is adapted to move the looper arms 32 in response to movement of the electrical switch means 14, as the notched needle 1 passes through the sewing material 6. Alternately, the open notched sewing needle 1 may provide a low voltage electric contact to an electrical switch means 14 located below the sewing material 6.

Figure 6:
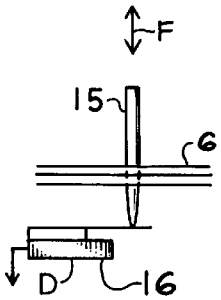
FIG. 6 is an alternate embodiment of FIG. 5, wherein an ancillary needle passes through the sewing material to actuate a switch located below the sewing material by contact or a low voltage electric current.

FIG. 6 shows an alternate embodiment of the lower unit sensing means D, wherein a ancillary needle 15 may be used to pass through the sewing fabric 6 in harmony with the cyclic, reciprocating movement of the notched needle 1, to selectively actuate a suitable mechanical switch means 16. Mechanical switch means 16 coordinates the movement of the looper arms 32 in relation to movement of the ancillary needle 15, in harmony with the linear, cyclic reciprocating actuation F of the notched needle 1 through the sewing material 6. Alternatively, the ancillary needle 15 may carry a low voltage electric current to an electrical switch means 14 located below the sewing material 6.

Thus the lower unit sensing means D may be any known magnetic switch means 9, sensor means 12, electrical switch means 14 or mechanical switch means 16 known in the art. A fluid (air or liquid) switch means (not shown) may also be used, without departing from the scope of this disclosure, or from the following claims.

The location of the lower unit sensing means D to coordinate movement of the needle 1, with complimentary movement of the looper arms 32, is preferably positioned toward the sewn portion of the sewing material 6. The location of the lower unit sensing means D to coordinate movement of the needle 1 with complimentary movement of the looper arms 32 may alternately be positioned in proximity to the position of the notched needle 1, to suit design or manufacturing preference.

The lower unit sensing means D to coordinate the movement of the needle 1, with complimentary movement of the looper arms 32 through the sewing material 6 may vary with the kind of sewing material 6 being sewn, the thickness or stiffness of the sewing material 6, the versatility of the sewing machine apparatus A, or design or manufacturing preference. While several example embodiments for coordinating movement of the looper arms 32 in response to the linear, cyclic reciprocating movement of the notched needle 1 are disclosed herein, any other known means of actuating the looper arms 32 in response to the cyclic reciprocating movement 84 of the notched needle 1 through the sewing fabric 6 are also intended to fall within the scope of this disclosure, and the following claims.

Figure 9:
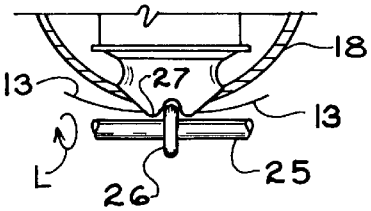
FIG. 9 is a cross section view of a portion of the bobbin case taken along lines 9—9 in FIG. 8.
Figure 7:
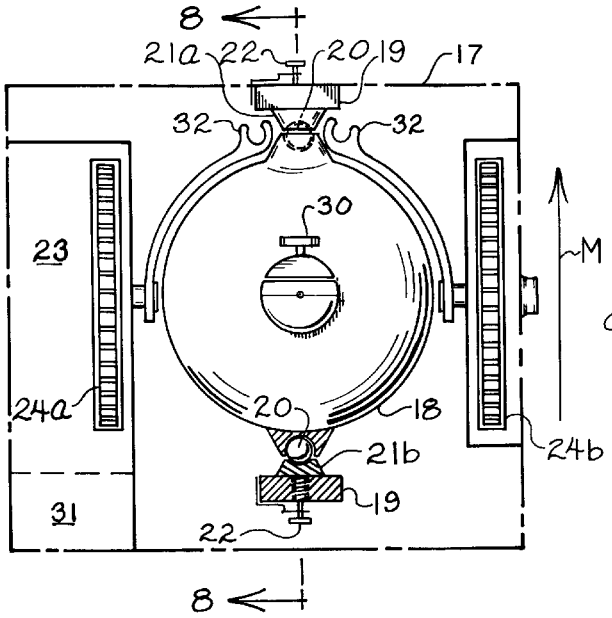
FIG. 7 shows a portion of the lower sewing machine mechanism having a bobbin case supported by end posts with ball and detent contacts.
Figure 8:
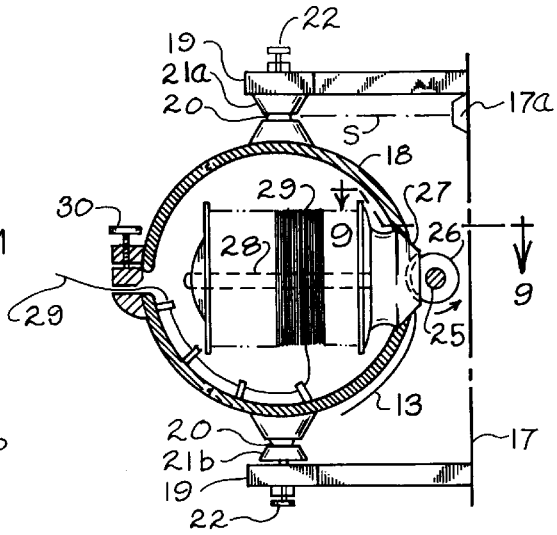
FIG. 8 is a cross sectional view of the bobbin case taken along lines 8—8 in FIG. 7.

Referring now to FIG. 7 and FIG. 8, a bobbin case 18 is located within the lower sewing machine mechanism C. The bobbin case 18 is preferably supported by ball detents 21*a*, 21*b* which are pivotally secured to end post(s) 19. Preferably the end post(s) 19 support movable balls 20 which are retained between the ball detent(s) 21 and the bobbin case 18. A looper motor 23 is located adjacent to the bobbin frame 17. A looper motor 23 is selectively actuated to rotate a first gear 24A positioned to bias at least one looper arm 32 for one revolution per signal H. A cross shaft 25 having rotation L may be used to drive a second gear 24B, which in turn is positioned to bias a second looper arm 32. A soft narrow doffing wheel 26 is preferably mounted on the cross shaft 25 to aid in doffing the thread loop 7 from the respective looper forks 32. This doffing action is also aided by two fin type projections 27 extending from the bobbin case 18, as shown in FIG. 9.

A micro-adjustable time delay relay 31 is located near to looper motor 23. The time delay relay 31 can be used to fine-tune the timing for initiating movement of the looper arms 32. The bobbin frame 17 has a boss 17*a* drilled for a securement pin (not shown) to permit rotation of the bobbin frame 17 around the vertical needle path S.

A suitable pin 28 is positioned in the bobbin case 18 to accept and retain a spool of bobbin thread 29 thereon. The distal end of the bobbin thread 29 extends through a suitable clamp 30, which serves to tension the bobbin thread 29 during use. Suitable access (not shown) to the spool of bobbin thread 29 is preferably provided through the bobbin case 18, for ease of installing the bobbin thread 29 spool, and for removing a used bobbin thread 29 spool, or for changing the type, color and/or size of the bobbin thread 29. An adjustable spring biasing means 22 is preferably adjusted to permit passage of the needle thread loop 7 around the bobbin thread case 18 through the ball-detent support points of the bobbin case 18, with the ball detent on the needle path 21*a* and subsequently with the ball detent off the needle path 21*b*.

In operation, as the notched needle 1 starts to rise from bottom dead center of the cyclic, reciprocating actuation, the needle thread 13 is doffed from the notched opening 1*a* of needle 1, and the needle thread 13 forms a loop 7 beneath the sewing material 6 as shown in FIG. 2. As this occurs, the motor 23 in the bobbin housing 17 is actuated by the lower unit sensing means D, which biases the looper arms 32, which serves to elongate the needle thread 13 loop 7. The looper arms 32 rotate to tighten the needle thread 13 and carry the needle thread 13 through the first ball 20 and detent support 21*a* of the bobbin case 18. Near the bottom of the looper arm 32 rotation, at a location substantially distant from the point of emergence of the loop 7 thus formed below the sewing material 6 and where there is a wide separation of the loop 7 around the bobbin case 18, the loop 7 is doffed from the looper arms 32. This is aided by fins 27 extending partially on each side of the doffing wheel 26, as shown in FIG. 9.

Figure 13:
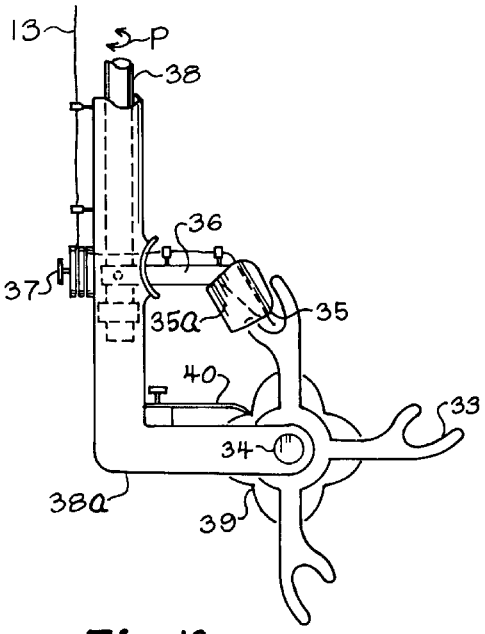
FIG. 13 is a partial side view of the notch threader and thread nozzle assembled on a carrying arm, utilizing an oscillating, rotational drive shaft.

The looper arms 32 are now free of the needle thread 13, as they continue to rotate within the doffed thread loop 7, and the abandoned loop of the needle thread 13 will be pulled through the last ball detent 21B and tensioned by the next rotation of the looper arms 32 as they expand the next loop. Thus the take-up and tensioning of each thread loop 7 is accomplished while expanding the subsequent loop 7; and the thread supply for expanding each loop comes from the abandoned previous loop plus a last increment that comes directly from the upper thread tensioner 37 as shown in FIG. 13. Expansion of the last doffed thread loop 7 around bobbin case 18, through ball detent on needle path 21*a* and subsequently through ball detent off needle path 21*b* entraps a segment of bobbin thread 29 and forms a lockstitch.

It is noted that the needle thread 13 flows through the forks of the looper arms 32 during expansion of the loop 7 from the notched needle 1. The flow of needle thread 13 comes from the last previous loop 7 located below the sewing material 6.

In conventional sewing machines, each increment of thread passes back and forth through a closed needle eye, whereas in the novel sewing machine apparatus A disclosed herein, the notched needle 1 releases the needle thread 13 to form a loop 7 that is enlarged by flow around large diameter looper arms 32, thus reducing needle thread 13 abrasion.

Tensioning of needle thread 13 occurs in the last previous stitch as the looper arms 32 approach the doffing position of the last stitch. To begin sewing, there must be a segment of the bobbin thread 29 pinched beneath the sewing material 6, and a segment of the needle thread 13 pinched on top of the sewing material 6, similar to current use on conventional sewing machines (not shown).

At the end of the sewing cycle, the sewing material 6 can be removed from under the notched needle 1. Removal of the sewing material 6 from beneath the notched needle 1 will take up the last thread loop 7 trapped between the doffing location and the second ball detent 21*b*, allowing the user to cut both the needle thread 13 and the bobbin thread 29.

The notched opening 1*a* on notched needle 1 may have any orientation in the horizontal plane about the vertical needle 1. However, the bobbin frame 17 is preferably orientated so that the looper arms 32 operate in a plane perpendicular to the plane of the loop 7 located beneath the sewing material 6.

Notch threading occurs during each notched needle 1 stroke, by utilizing two threader forks 33 which closely straddle the notched needle 1 in the upper sewing mechanism B. The needle thread 13 passes through both threader forks 33, causing the thread 13 to press against the notched needle 1 shaft 2. A small, precise aperture or thread nozzle 35, provides passage of needle thread 13 across the threader forks 33. The thread nozzle 35 positions the thread 13 over a pair of threader forks 33 which catches the thread 13 between the threader forks 33.

Figure 10:
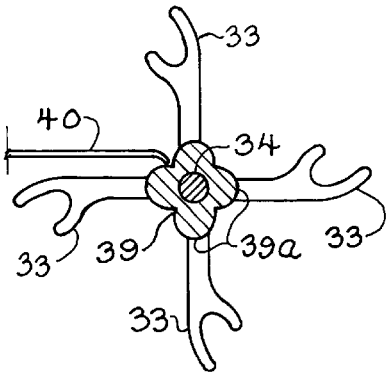
FIG. 10 is a side view of a notch threader having a plurality of thread carrying forks arranged about a common center of rotation.
Figure 11:
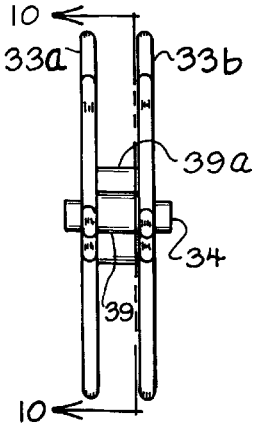
FIG. 11 is an end view of the notch threader shown in FIG. 10.

FIG. 10 is a side view of the threader forks 33 which is capable of rapid operation. FIG. 11 is an end view of the threader forks 33 shown in FIG. 10. Multiple pairs of thread carrying forks 33*a* and 33*b* are attached to a sculptured spindle 39 to position the threader forks 33 on shaft 34. The sculptured spindle 39 comprises multiple lobes 39*a*. A spring detent 40 is preferably positioned to bias against the sculptured spindle 39 between adjacent lobes 39*a*, to accurately position the forks 33*a* and 33*b* on each linear, cyclic reciprocating actuation F of the notched needle 1.

In FIG. 13, the thread nozzle 35 and its carrying arm 36 arc across the vertically oriented pair of forks 33, while a previously threaded pair of threader forks 33 is positioning the needle thread 13 against the rising needle shank 2 and the notch opening 1*a* on the notched needle 1.

Figure 12:
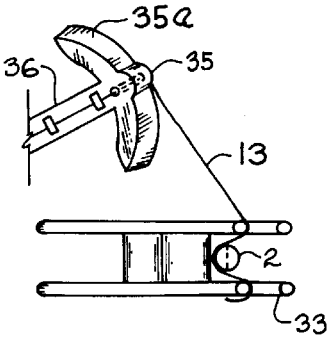
FIG. 12 is a partial view of the needle thread extending between the thread nozzle and the notch threader.

The thread nozzle 35 oscillates back and forth about axis P on an oscillating shaft 38 in harmony with the linear, cyclic reciprocating actuation F of the notched needle 1. As the notched needle 1 descends with needle thread 13 positioned between the threader forks 33, the threader forks 33 rotate to reposition the needle thread 13 against the notched needle shaft 2, where it is subsequently captured in the notch opening 1*a* on each downward stroke of the notched needle 1. Each downward stroke of the notched needle 1 recaptures a portion of the needle thread 13 held in position between the threader forks 33, causing the threader forks 33 to rotate to reposition the needle thread 13 against the needle shaft 2. Thus, the needle thread 13 is captured upon each downward stroke of the notched needle 1 at a location above the sewing material 6, and the needle thread 13 is released in the form of a loop 7 located beneath the sewing material 6 on each upward stroke of the notched needle 1. Simultaneously, the adjacent threader forks 33 are being threaded by a rocking action of the thread nozzle 35 in preparation for the next cycle of reciprocating actuation 84 of the notched needle 1. As shown in FIG. 12, extensions 35*a* on each side of the thread nozzle 35 prevent accidental rotation of the forks 33 while threading.

To guard against partial rotation or misalignment of the array of the threader forks 33 during thread tensioning by the looper arms 32, adjacent lobes 39*a* of the sculptured spindle 39 are preferably rotatably positioned with the aid of a spring detent 40, which is positioned to bias between the adjacent lobes 39*a* of the sculptured spindle 39, as best shown in FIG. 10.

An alternate embodiment of the sewing machine apparatus is shown in FIG. 14 through FIG. 17, wherein the notched threader means 43 comprises a rotating drive shaft 41, rather than the oscillating shaft 38 shown in FIG. 13. The rotating drive shaft 41 biases an offset cam member 41*a* which is slidably received in a cam slot 47*a* to bias the two forked carrier 42 back and forth. An articulated thread nozzle 44 pivots about a pivot pin 45A in harmony with the linear, cyclic reciprocating actuation F of the notched needle 1. The articulated nozzle 44 oscillates in response to a cam roller 45 riding in a horseshoe slot 47 in a cam plate 46. (See FIG. 16 and FIG. 17.) The thread 13 slips off the forks 43 on the two fork carrier 42, as the two fork carrier 42 is moved away from the needle path S. This occurs as the notched needle 1 descends toward the sewing material 13.

Figure 14:
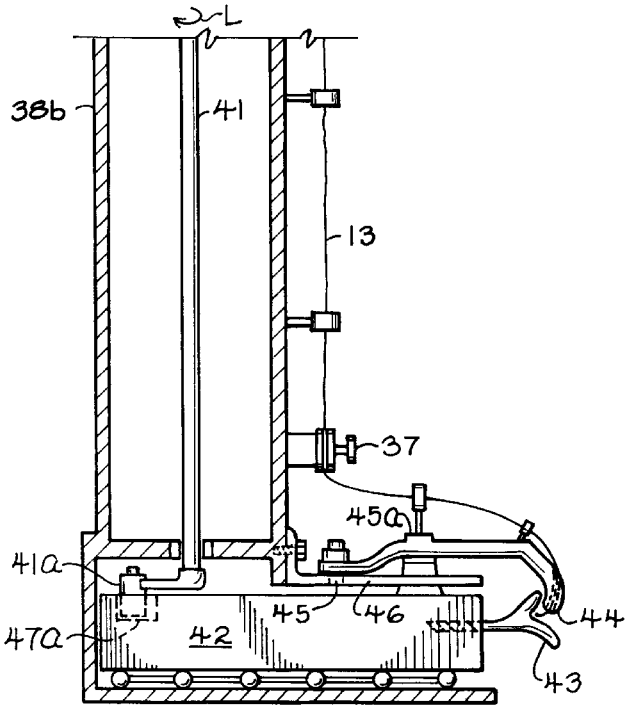
FIG. 14 is a partial side view of an alternate embodiment of the notch threader utilizing a continuously rotating drive shaft and a sliding threader fork carrier.
Figure 17:
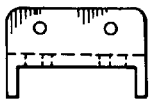
FIG. 17 is an end view of the cam plate shown in FIG. 16.
Figure 16:
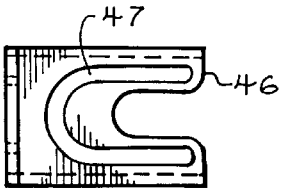
FIG. 16 is a detailed view of a horseshoe slot located in a cam plate shown in FIG. 14.
Figure 15:
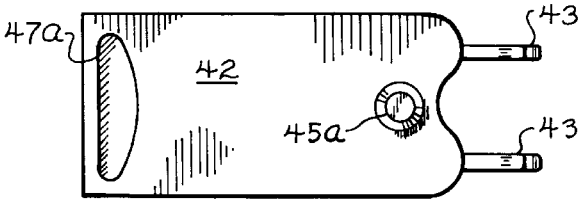
FIG. 15 is a partial top view of the slide assembly, taken along lines 15—15 in FIG. 14.
Figure 18:
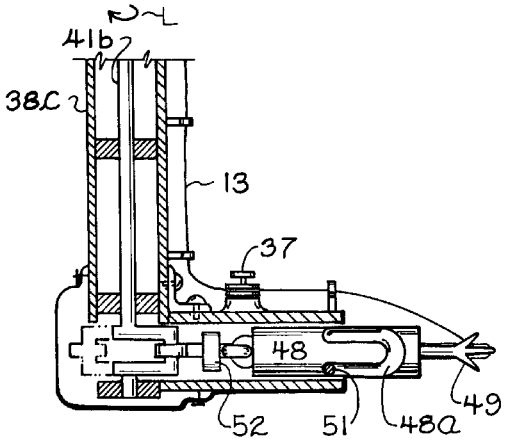
FIG. 18 is a partial side view of an alternate embodiment of the needle threader shown in FIG. 14, embodying an oscillating cylinder actuated by rotation of a fixed cam.
Figure 19:
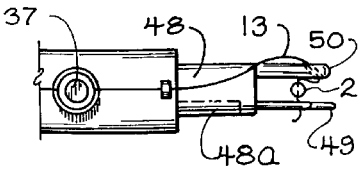
FIG. 19 is a partial top view of the needle threader shown in FIG. 18.

FIG. 18 shows an alternate embodiment of the needle notch threader apparatus 33 shown in FIG. 14. In this configuration, a cylindrical shaft 48 carries a three tined fork 49 on one side and a thread nozzle 50 on the other, to straddle the needle shank 2, as shown in FIG. 19. On each downward stroke of the needle 1, the needle thread 13 goes from the nozzle 50 down to the sewing material 6, as the thread nozzle is oscillated in response to movement of the notched needle 1.

Cylindrical shaft 48 is preferably rotated by a fixed cam 51, which rides in the horseshoe shaped groove 48A in cylindrical shaft 48. The cylindrical shaft 48 is cycled back and forth in relation to the movement of the notched needle 1 by the continuously rotating threader drive shaft 41*b* and preferably geared to the notched needle 1 drive on a 1:1 basis.

A rotary coupling 52 is connected between the lower crank portion of threader drive shaft 41*b* and cylindrical shaft 48. As the cylindrical shaft 48 is cycled back and forth about its long axis, it is oscillated toward and away from the notched needle 1. A three tined fork 49 is positioned to always rotate between the thread nozzle 50 and the sewing material 6. Upon rotation, the center tine of the three tined fork 49 catches the needle thread 13 between the thread nozzle 50 and the sewing material 6, causing the thread 13 to be held between the thread nozzle 50 and the three tined fork 49 before being thrust against the needle shank 2.

The direction of movement of the sewing material 6 relative to the orientation of the bobbin frame 17 establishes the kind of stitch sewn as between a lock stitch or a chain stitch. An additional factor is the presence or absence of the bobbin thread 29 in operation. The orientation of the bobbin frame 17 is indicated by the arrow M in FIG. 7.

For example, when the flow direction of the sewing material 6 is opposite to the direction indicated by the arrow M, and the bobbin thread 29 is operative, a lock stitch is sewn. When the material flow direction and the arrow M are in the same direction, and the bobbin thread 29 is not operative, a chain stitch is sewn. In this latter case, if the bobbin thread 29 is operative, a chain stitch is sewn with the bobbin thread 29 weaving in and out through the stitches below the sewing material 6.

When the bobbin frame arrow M is 90 degrees to the material flow direction and the bobbin thread 29 is operative, a lock stitch is sewn in each of the two directions the material 6 may flow.

The orientation of the needle notch 1*a*, as pointed out earlier, need only be such that the plane of the needle thread loop 7 left below the sewing material 6 be 90 degrees to the plane of the looper arms 32, which is 90 degrees also to the orientation of arrow M. Thus, an 180 degree change in material flow direction, with no change in the orientation of the bobbin frame 17, as indicated by orientation arrow M, requires no change in the orientation of the needle 1 open notch 1*a* .

Thus, the operator preferably has a choice the selection of the stitch sewn in the orientation of the bobbin frame 17 in relation to the material flow direction. The adjustment of the upper sewing mechanism B in relation to the lower sewing mechanism C may be accomplished by electrical, mechanical, or manual operator adjustment means.

Rotation of the needle notch opening 1*a* will require a similar rotation of the notch threading apparatus shown in FIG. 13, FIG. 14 and FIG. 18. This rotation of the notch threader apparatus 33 involves rotation of their frames and their respective threader drive shaft 41. Any relocation of the lower unit sensing means D in the lower sewing machine mechanism C can readily be accomplished since they all have only electric wire connection to the time delay relay 31 and looper motor 23 in the lower sewing machine mechanism C.

Figure 20:
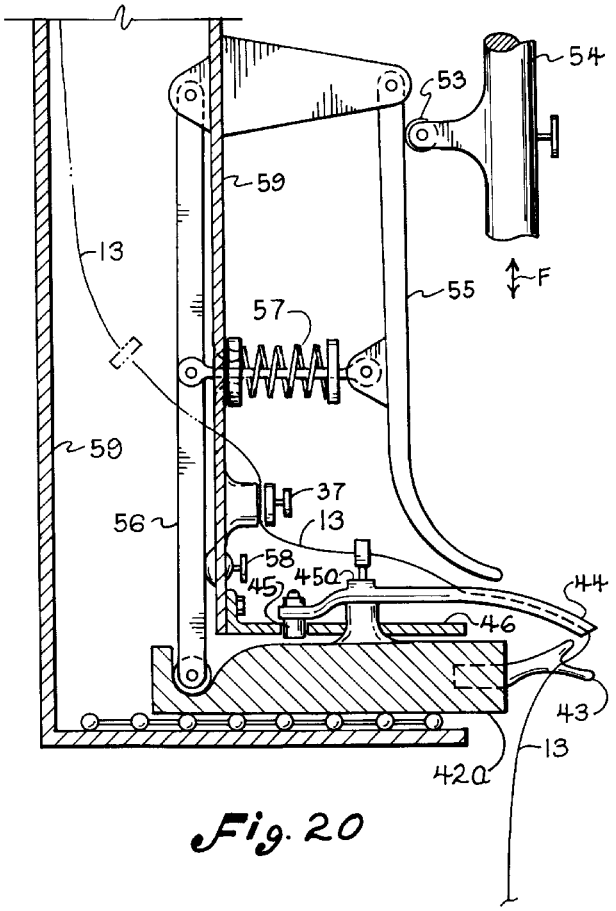
FIG. 20 is a side view of an alternate embodiment of the notch threading system utilizing either of the threading principles shown in FIG. 14 or FIG. 18, and actuated by the oscillations of the needle holding shaft.

FIG. 20 shows an alternate notch threading system using the threading principal shown in either FIG. 14 or FIG. 18. The drive for the threader comes from the needle drive shaft 54. A Cam roller 53 is attached to the needle drive shaft 54, which operates against a movable cam plate 55 to cycle the slider 42*a* back and forth, to selectively position the needle thread 13 on the threader forks 43. Oscillating shaft 56 accentuates the movement of slider 42*a,* while a suitable spring 57 selectively biases cam plate 55 and slider 42*a* towards the threading position, where needle thread 13 is positioned adjacent to the notched needle shank 2. An adjustable stop 58 limits the motion of shaft 56, which in turn limits the movement of slider 42*a* and threader forks 43. Frame 59 may be rotated about the needle drive shaft 54, to accompanying any desired rotation of the open needle notch 1*a*. Adjustable stop 58 also serves to reduce the precision required to orient the rotatable frame 59 in relation to the upper and lower sewing machine mechanisms B and C.

Figure 21:
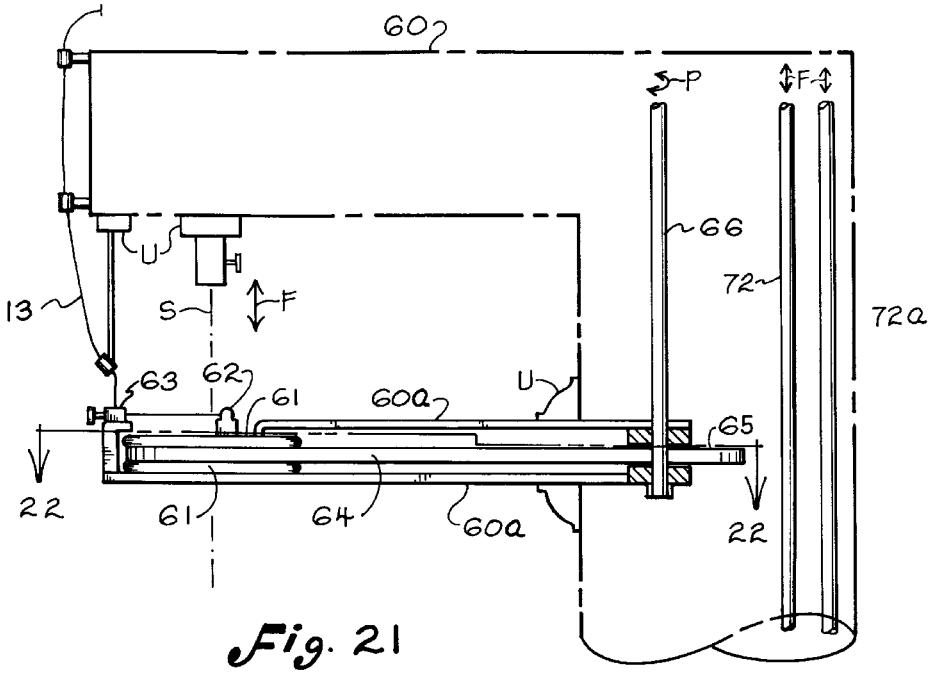
FIG. 21 is a partial side elevation view of an alternate embodiment of a notch threading mechanism having a rotating, oscillating drive timed to the needle position via a rotatable ring around the needle path and driven by a timing belt from an oscillating drive wheel timed to the needle position.
Figure 22:
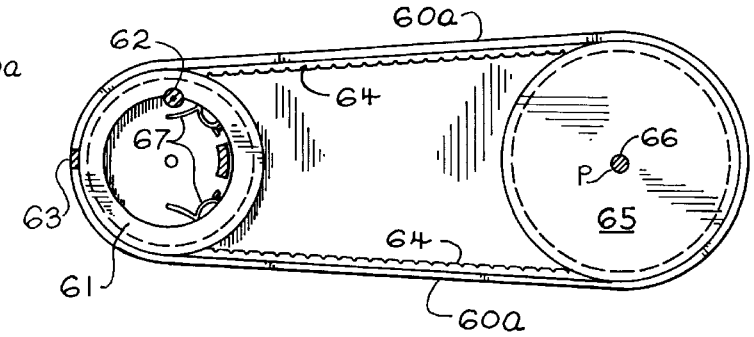
FIG. 22 is a detail view of the timing belt and oscillating drive wheel shown in FIG. 21.

FIG. 21 and FIG. 22 disclose an alternate embodiment of a needle threading device E that is relatively simple to accommodate rotation of the needle notch opening 1*a*, but requires the use of an oscillating drive wheel 65 timed to the notched needle 1 position. As shown in FIG. 21, a sub-frame 60*a* supports a rotatable ring 61 that carries a thread nozzle 62, and also supports a fixed thread tensioning device 63 and thread holding clips 67. The rotatable ring 61 is centered on the notched needle 1 path and is driven by the timing belt 64 from an oscillating drive wheel 65 that is timed to the needle position and drive shaft 66. The sub-frame 60*a* is preferably supported by the upper frame 60. Upper frame 60 preferably also supports a motor drive J, a linear, cyclic, reciprocating needle drive mechanism F, and a signaling means H. The upper frame 60 also supports an advance system K using a sub-frame 77, as well as the sub-frames for the selected notch threading system.

Figure 23:
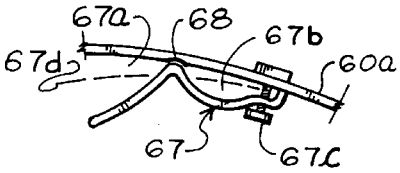
FIG. 23 is a partial view of one of the thread holding clips shown in FIG. 22.

Referring now to FIG. 22 and FIG. 23, two thread holders 67 are located on rotatable ring 61. The thread holders 67 are orientated to hold the needle thread 13 in a looped position 67*b* on one side of the notched needle 1, to provide sufficient wrap of the needle thread 13 on the other side 67*a* of the notched needle 1 to cause the needle thread 13 to enter the notch opening 1*a* as the notched needle 1 reaches substantially the highest point of its cyclic, reciprocating travel. To do this, rotatable ring 61 is rotated about 240 degrees. This is accomplished by making the drive wheel 65 larger in diameter than the rotatable ring 61. This is based on a maximum oscillation of the drive shaft of 180 degrees.

The thread holding clips 67 first trap the needle thread 13 from the oscillating thread nozzle 62 when the thread nozzle 62 first moves over the looped position 67*b,* leaving the needle thread 13 over notch 68 and along the thread path 67*d,* of a first thread holding clip 67. The subsequent down stroke of the notched needle 1 jerks the needle thread 13 into the looped position 67*b* and down to the sewing material 6 from the thread nozzle 62. The thread nozzle 62 then arcs back around the needle 1 to a position over loop 67*b* of the second thread holding clip 67, leaving the needle thread 13 bearing against the needle 1 shank 2 and along the thread path 67*d.* On the next down stroke of the open notched needle 1, the needle thread 13 in the looped position 67*b* of the first thread holding clip 67 is jerked down through notch 68 and hence to the sewing material 6. At the same time at the second thread holding clip 67 the needle thread 13 is jerked from a position over notch 68 into loop 67*b*, and down to the sewing material 6 while the thread nozzle 62 lies over loop 67*b*.

Thus, at each thread holding clip 67, a first open notched needle 1 down stroke pulls the needle thread 13 from a notched position 67*a* into looped position 67*b*. A second open notched needle 1 down stroke pulls the needle thread 13 out of the looped position 67*b* and down to the sewing material 6, and the thread nozzle 62 cycles back again to re-thread the thread holding clips 67 again. The thread holding clips 67 shown in FIG. 23 each have an adjustable clamp means 67*c* to suit the forces required with different thread sizes and characteristics.

In conventional sewing machines, the sewing material 6 is advanced by the lower portion of the sewing machine, and is typically provided by a arcing, buttressed cam with arc height adjustment to create different stitch spacing (not shown). The advance can only occur when the needle is clear of the sewing material 13. This limits conventional arc time for material advance, and further requires timing precision. In this application, as shown in FIG. 24 and FIG. 25, drive wheels 69 are located above the sewing material 13 so that precise timing can easily be determined.

Figure 24:
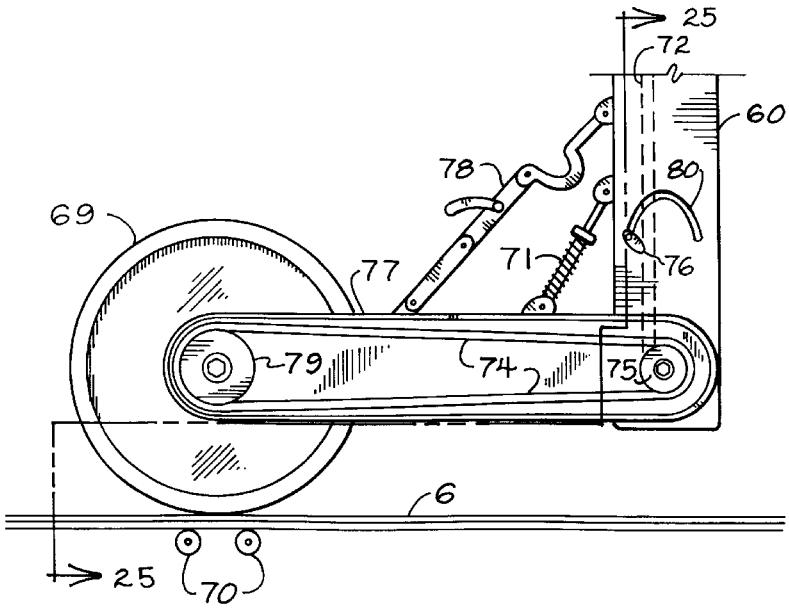
FIG. 24 is a partial side elevation view of a rotating material advance mechanism located above the sewing material and a pair of rollers located below the sewing material.

FIG. 24 discloses a novel material advance apparatus 76, wherein at least one advance wheel 69 is located on top of the sewing material 6. Advance wheel(s) 69 are positioned over at least one roller(s) 70 located beneath the sewing material 6. The sewing material 6 is pinched between the advance wheel(s) 69 and roller(s) 70 by a suitable biasing means 71, such as a spring. Preferably, two advance wheels 69 are positioned above the sewing material 6, and two rollers 70 are located beneath the sewing material 6 in alignment with the advance wheels 69. The advance wheels 69 are driven by a vertically reciprocating shaft 72 timed to harmonize with the linear, cyclic, reciprocating actuation F of the notched needle 1. Vertically reciprocating Shaft 72 preferably has a ratchet engaging member (not shown) that drives a ratchet gear 73 shown in FIG. 25. The ratchet gear 73 is secured to a common shaft with two timing belt drive wheels 75. The side of the ratchet gear 73 actuates the timing belt drive wheels 75 to drive a timing belt 74, which in turn rotates driven wheels 79 to rotate material advance wheels 69. The timing belt drive wheels 75 may be reversed by selectively positioning the side of the ratchet gear 73 that is actuated by the linear reciprocating motion of shaft 72. This may be accomplished by moving drive shaft 72 using handle 76 in slot 80 shown in FIG. 24.

The upper frame 60 of upper sewing machine mechanism B is preferably adapted to carry a suitable motor drive J, a needle drive mechanism G, a notch threading apparatus E, and a signaling means H. An advance system sub-frame 77 may be hinged to upper frame 60 to support a common shaft of timing belt drive wheels 75 and ratchet gear 73. Thus, each advance wheel 69 has some independent vertical motion. Lever arm 78 can be raised to lift the advance wheels 69 for placing or removing the sewing material 6 from between the advance wheels 69 and the rollers 70.

Figure 25:
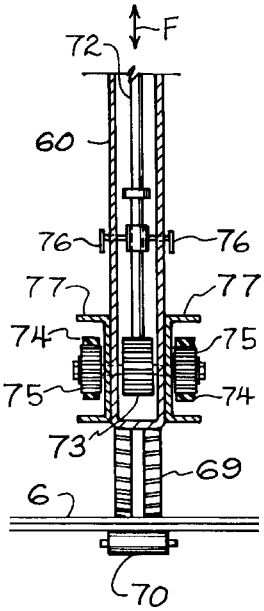
FIG. 25 is a partial end view of the rotating material advance mechanism shown in FIG. 24.

Small driven wheels 79 may alternately be driven by a timing belt 74 as shown in FIG. 25, to eliminate advance wheels 69 shown in FIG. 24. In this adaptation, the timing belt 74 is positioned directly over rollers 70. This arrangement may be desirable for placing the center of the wheels 79 on the vertical path of the notched needle 1, which would not interfere with the needle threader apparatus E selected.

When one or more large advance wheel(s) 69, shown in FIG. 24, are used, the advance wheel(s) 69 may be centered downstream of the needle path. In this adaptation, a conventional pressure foot (not shown) may be attached to one of the advance system sub-frame 77, and positioned to surround the notched needle 1 path.

Figure 26:
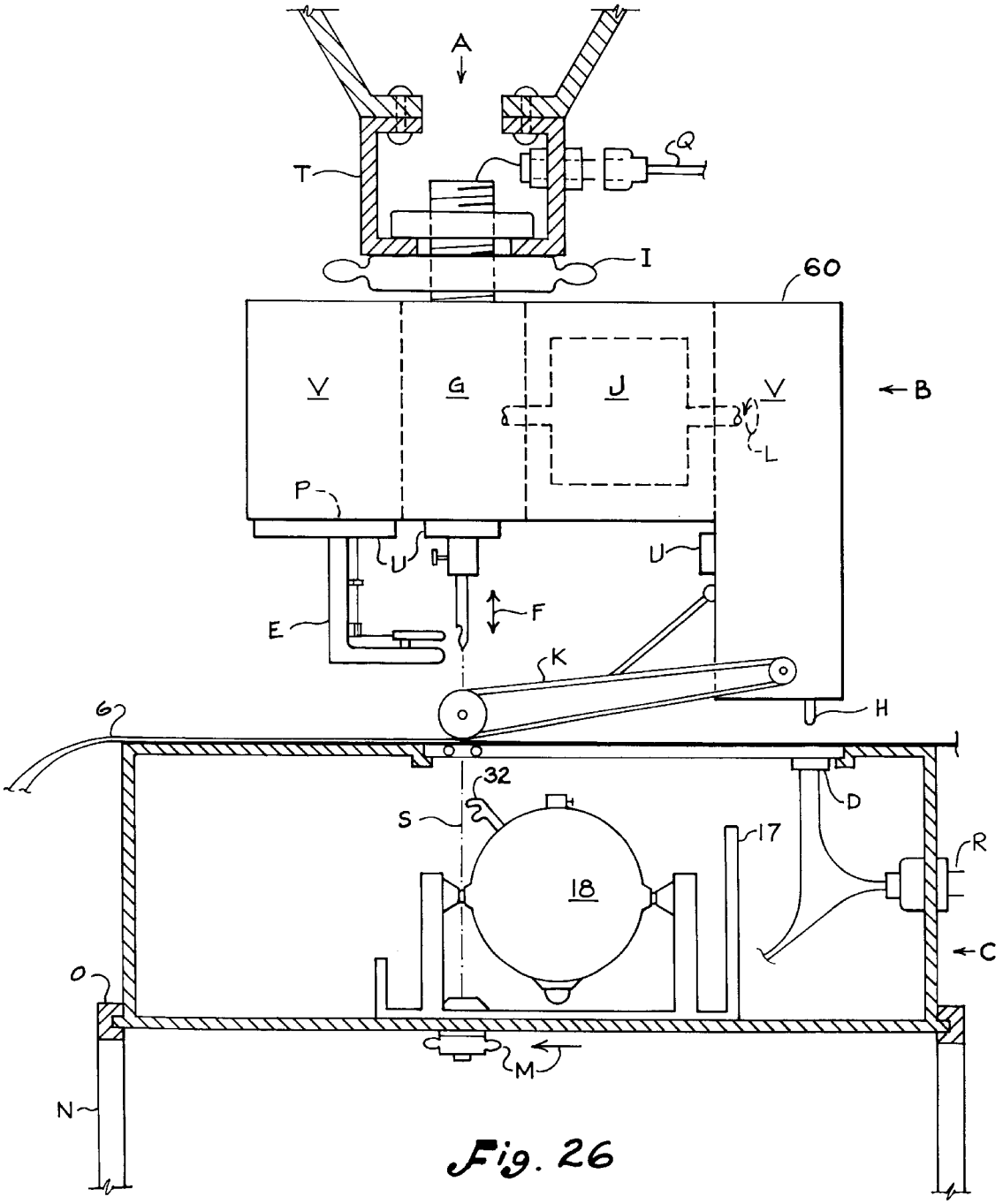
FIG. 26 is a side elevation view of the upper sewing machine apparatus supported from above, and a lower sewing machine apparatus mounted to a table in alignment with the upper sewing machine apparatus.

The novel sewing machine apparatus A thus disclosed, and shown in FIG. 26, comprises separate upper and lower sewing mechanisms B, C respectively, which may be separately powered, and separately supported, enabling the user to sew large fabric sections without limitation of a conventional frame member extending between upper and lower sewing mechanisms B, C, and without mechanical, electrical, hydraulic or other connections between the sewing mechanisms B, C, for timing their operation. Timing is accomplished by the cyclic, reciprocating actuation of a sewing needle and a sensing means located beneath the sewing material 6. The upper and lower sewing mechanisms B, C are positioned and aligned to operate in coordination with each other.

The upper sewing mechanism B is positioned over the lower sewing mechanism C so that the notched needle 1 of the upper sewing mechanism B meets a suitable target region in the lower sewing mechanism C. Eyeball precision is sufficient, as slight variations in both the vertical and horizontal position of the upper and lower sewing mechanisms B, C can be accommodated. The depth of penetration of the notched needle 1 has an influence on the size of the loop 7 of thread located below the sewing material 13. Both upper and lower sewing mechanisms B, C should be aligned and locked into position prior to operation of the sewing machine apparatus A. The reaction force of advancing the sewing material 13 acts primarily on the upper sewing mechanism B. Thus, the upper sewing mechanism B is preferably provided with conventional minor adjustment means in three dimensions at the attaching points. Both upper and lower sewing mechanisms B, C are preferably rotatable about the vertical paths of the notched needle. Slotted supports O may be provided to accommodate a choice of mounting positions.

Some industries now use a plurality of side-by-side sewing machines. The sewing machine apparatus A disclosed herein may be adapted for use on a long table support means N, such as slotted supports O for securement of the lower sewing mechanism C, and a ceiling mounted upper support means T, such as slotted supports located eight to twelve inches above the slotted table, for supporting the upper sewing mechanism B. With this adaptation, any number of sewing machine apparatus A may be located upon the table support means N, as desired, while providing no restriction for sewing large canvas or other large sewing materials 6. See FIG. 26. The slotted supports T in the upper unit B and O in the lower unit C allow a choice of location of the stitch line. The frame 60 of the upper unit B encloses, in addition to the motor J with rotation L, the needle drive mechanism G, the transmission system V for driving a needle threader E, and the material advance system K, and signal means H. Bosses U provide bases for attachment of the sub-frames described herein.

In the lower sewing machine mechanism C, the sensing means D initiates movement of the looper arms 32 (only one is shown). Rotation of the bobbin frame 17 around the orientation means M, on the vertical needle path S determines the type of stitch sewn.

Each upper and lower sewing mechanism B, C will need an electrical outlet Q, R for its respective motor drive J, looper motor 23, and signal means H. A foot actuated rheostat (not shown) may be used to control speed and operation of the upper sewing mechanism B, while the lower sewing mechanism C is preferably adapted with manually set controls (not shown) for maximum speed, since the lower sewing mechanism C operates only in response to each notched needle 1 stroke.

Where many pairs of sewing machine apparatus A are working on the same sewing material 6, such as when sewing large tents, tarps or covers, a manually adjustable speed control panel (not shown) may be used, with controls for each sewing machine apparatus A. In this adaptation, all selected sewing machine apparatus A could be simultaneously operated by one person.

Sewing in one direction will result in a lockstitch, while reversing the sewing direction will result in a chain stitch with the bobbin thread 29 positioned through each loop 7 located beneath the sewing material 13. A 180 degree rotation of the lower sewing mechanism C in relation to the upper sewing mechanism B, where the bobbin thread 29 is not operative, will create a chain stitch. Rotation of the lower sewing mechanism C just 90 degrees, with the bobbin thread 29 operative, will result in creating a lock stitch sewn in either forward or reverse directions.

It should be noted that reference to upper sewing machine mechanism B and lower sewing machine mechanism C are made to simplify and clarify the references and description. In operation, the orientation of the upper sewing machine mechanism B and lower sewing machine mechanism C with respect to gravity can be in any plane; the only orientation required is that of one unit with respect to the other.

It should also be recognized that a totally new and different sewing system is described herein, having many sub-parts, all of which are required for the system to function, and hence are described in this specification. The various signaling and notch threading systems disclosed herein are included to accommodate different uses expected of the disclosed sewing machine apparatus A from industrial to home use, from single stitch to dual stitch capacity, and from light to very heavy material being sewn.

Thus, while the improved sewing machine apparatus A has been fully disclosed and described, numerous modifications will become apparent to one of ordinary skill in this art, and such adaptations and modifications are intended to be included within the scope of the following claims:

What is claimed is:

1. A sewing machine apparatus having an upper sewing machine mechanism and a lower sewing machine mechanism that in proper juxtaposition can selectively sew one of a lock stitch and a chain stitch with no continuous mechanical, electrical, hydraulic connection for purposes of timing their cooperation, the timing being accomplished by the cyclic, reciprocating actuation of a sewing needle and a sensing means located beneath the sewing material, the sewing machine apparatus comprising:

a) an upper sewing mechanism secured to an upper support means, the upper sewing mechanism having a cyclic, reciprocating actuation means, the cyclic, reciprocating actuation means adapted to raise an open notched needle above the sewing material in a substantially raised position, and to lower the notched needle to penetrate the sewing material in a substantially lowered position;

b) the open notched needle having a shank with a needle end, a raised notch opening on the shank near the needle end, the notched opening on the shank positioned to receive a portion of needle thread therein, and to thrust the needle thread beneath the sewing material on a downward stroke of the notched needle, whereupon the needle thread is released from the open notched needle to form a needle thread loop beneath the sewing material as the open notched needle is raised above the sewing material;

c) a lower sewing mechanism secured to a table support means, the lower sewing mechanism having a sensing means located beneath the sewing material, for sensing the position of the open notched needle during its cyclic, reciprocating actuation for synchronizing the movement of a bobbin assembly in harmony with the linear, cyclic, reciprocating actuation of the notched needle;

d) the bobbin assembly located within the lower sewing machine mechanism, the bobbin assembly having a thread tensioning means responsive to the sensing means for selectively enlarging a last thread loop while tensioning a previous needle thread loop located beneath the sewing material;

e) a notched threader means for positioning a portion of the needle thread into the raised notch opening as the notched needle moves on said downward stroke of its cyclic, reciprocating actuation; and f) an orientating means for selectively orientating the lower sewing machine mechanism in relation to the upper sewing machine mechanism about the notched needle, the orientating means for selectively determining a specific type of sewing stitch selected from a lock stitch and a chain stitch.

2. The sewing machine apparatus of claim 1, wherein the needle thread tensioning means comprises one or more pairs of forked arms rotatably positioned to enlarge a needle thread loop and then to pass the needle thread loop around a bobbin case.

3. The sewing machine apparatus of claim 2, wherein the forked arms are further adapted to provide take up and tensioning action on a previously enlarged needle thread loop.

4. The sewing machine apparatus of claim 1, wherein the needle thread tensioning means is located in the lower sewing machine mechanism.

5. The sewing machine apparatus of claim 1, wherein the open notched needle has a shank which is substantially round, with a positioning means located on the end opposite the needle end to orient the needle in relation to the upper sewing mechanism, the open notched needle further having an open notch with an inwardly curved entry portion extending along an enlarged cross section of the open notched needle in the open notch area, with a straight line along the lower boundary of the notch, and with an arcuate portion tangent to a distal portion of the needle.

6. The sewing machine apparatus of claim 1, wherein the sewing material is advanced by at least one advance wheel positioned above the sewing material, and at least one roller positioned beneath the sewing material, the advance wheel and roller positioned to engage and selectively advance the sewing material beneath the notched needle, as the notched needle is moved in a cyclic, reciprocating actuation.

7. The sewing machine apparatus of claim 1, wherein the sensing means comprises a magnetic pin positioned above the sewing material which is actuated in harmony with the cyclic, reciprocating actuation of the notched needle, and a magnetic switch is located beneath the sewing material, the magnetic switch positioned to be responsive to the cyclic, reciprocating movement of the magnetic pin.

8. The sewing machine apparatus of claim 1, wherein the sensing means comprises a sensor located beneath the sewing material, and wherein the sensor is responsive to the cyclic reciprocating actuation of an ancillary pressure pin located above the sewing material, as the ancillary pin moves in harmony with the cyclic reciprocating actuation of the notched needle.

9. The sewing machine apparatus of claim 1, wherein the sensing means comprises a switch located beneath the sewing material, and wherein the switch is responsive to the cyclic, reciprocating movement of the open notched needle through the sewing material, as the switch means is biased by the notched needle beneath the sewing material to position the bobbin assembly in harmony with the linear, cyclic reciprocating actuation of the notched needle.

10. The sewing machine apparatus of claim 9, wherein the sensing means comprises a switch biased by mechanical contact with the cyclic, reciprocating actuation of the open notched needle.

11. The sewing machine apparatus of claim 9, wherein the sensing means comprises a switch biased by a low voltage current passing through the cyclic reciprocating actuation of the open notched needle.

12. The sewing machine apparatus of claim 1, wherein the sensing means comprises an ancillary pin located above the sewing material, and wherein the ancillary pin penetrates the sewing material in a cyclic, reciprocating actuation to bias a switch located beneath the sewing material to position the bobbin assembly in harmony with the cyclic, reciprocating actuation of the open notched needle.

13. The sewing machine apparatus of claim 12, wherein the sensing means is actuated by mechanical contact with the ancillary pin as the pin penetrates the sewing material.

14. The sewing machine apparatus of claim 12, wherein the sensing means is actuated by a low voltage current passing through the ancillary pin as the pin penetrates the sewing material.

15. The sewing machine apparatus of claim 1, wherein the lower sewing mechanism includes a bobbin assembly having a bobbin case supported on end posts at at least two discrete points, the lower sewing mechanism further having a looper motor that is selectively actuated by a sensing means located beneath the sewing material, the looper motor positioned to rotate at least two gears, the gears positioned to bias at least one pair of looper arms positioned to straddle said two discrete points, in harmony with the linear, cyclic, reciprocating actuation of the notched needle.

16. The sewing machine apparatus of claim 1, wherein a needle threader means comprises a cylinder biased by a cam which rides in a horseshoe shaped groove located on the cylinder, in response to the cyclic, reciprocating actuation of the open notched needle, the cylinder having a three tined fork positioned on one side of the notched needle and a thread nozzle positioned on the opposite side of the notched needle, and wherein the needle thread extends between the thread nozzle and the three tined fork to position the needle thread against the open notched needle to engage the needle thread in the notch opening of the open notched needle, as the cylinder is oscillated in response to the cyclic, reciprocating movement of the open notched needle.

17. The sewing machine apparatus of claim 1, wherein the needle threader means comprises a cam roller on the needle drive shaft which is selectively biased against a movable cam plate, which acts against an oscillating shaft to bias a slider having threader forks positioned to receive needle thread from an oscillating thread nozzle to selectively position the thread against the open notched needle to engage the needle thread in the notch opening of the open notched needle, in harmony with the cyclic, reciprocating actuation of the open notched needle.

18. The sewing machine apparatus of claim 1, wherein a notched needle threader means comprises an oscillating drive wheel responsive to the position of the notched needle, and wherein the oscillating drive wheel biases a timing belt which biases a rotatable ring on which is positioned a thread nozzle that oscillates between two thread holders in cooperation with the thread nozzle to hold the needle thread in a looped position around the open notched needle shank to bias the needle thread against the open notched needle to engage the needle thread in the notched opening in the notched needle on each downward stroke of the notched needle, in harmony with the cyclic, reciprocating actuation of the open notched needle.

19. A sewing machine apparatus for sewing large portions of sewing material, comprising:

a) an upper sewing mechanism supported by an upper support means, the upper sewing machine mechanism having a cyclic, reciprocating actuation means, the cyclic, reciprocating actuation means adapted to raise an open notched needle above the sewing material in a substantially raised position, and the cyclic, reciprocating actuation means further adapted to move the open notched needle downward to penetrate through the sewing material in a substantially lowered position;

b) the open notched needle having a shank with a needle end, with a raised notch opening positioned on the shank near the needle end, the raised notched opening positioned to receive a portion of the needle thread therein, and to thrust the needle thread beneath the sewing material on a downward stroke of the notched needle, whereupon the needle thread is released from the raised notch opening to form a loop beneath the sewing material as the notched needle rises above the sewing material on an upward stroke of the notched needle;

c) a lower sewing mechanism secured to a table support means, the lower sewing mechanism having a sensing means located beneath the sewing material, for sensing the proper position of the open notched needle during its cyclic, reciprocating actuation, and for synchronizing the movement of a bobbin assembly in harmony with the cyclic, reciprocating actuation of the open notched needle;

d) the bobbin assembly located in the lower sewing mechanism, the bobbin assembly having at least one pair of looper arms responsive to the sensing means for selectively enlarging a last needle thread loop while tensioning a previous needle thread loop located beneath the sewing material, the bobbin assembly further having a bobbin thread extending from the bobbin case to the sewing material, the looper arms positioned for advancing the needle thread loop around the bobbin case to form a lock stitch therebetween;

e) an upper sewing mechanism having a notch threader means, with two forks positioned to straddle the notched needle and to position the sewing thread against the notched needle shank to engage the sewing thread in the notch opening as the open notched needle moves downwardly in its cyclic, reciprocating actuation; and f) the upper sewing mechanism supported independently of the lower sewing mechanism, and the upper and lower sewing mechanisms orientated in spaced relation to each other.

20. The sewing machine apparatus of claim 19, wherein multiple sewing apparatus are arranged in side by side relation, with a plurality of lower sewing mechanisms mounted upon an elongated table support means, and a plurality of upper sewing mechanisms mounted to an upper support means, the multiple upper sewing mechanisms positioned in alignment with the respective multiple lower sewing mechanisms, and wherein the sewing material is free to advance between the upper and lower sewing mechanisms without interference of a support and other interferences extending between the multiple upper and lower sewing mechanisms.

21. The sewing machine apparatus of claim 19, wherein the upper sewing mechanism is provided with an adjustment means, the adjustment means including a horizontal adjustment means, a vertical adjustment means and a lateral adjustment means, the adjustment means providing a way to orient the upper multiple sewing mechanisms in alignment with the respective multiple lower sewing mechanisms.

22. The sewing machine apparatus of claim 19, wherein the multiple lower sewing mechanisms are rotated in relation to the multiple upper sewing mechanisms to selectively produce a type of sewing stitch selected from a lock stitch and a chain stitch.

23. The sewing machine apparatus of claim 19, wherein the sewing material is advanced by at least one advance wheel positioned above the sewing material, and at least one roller positioned beneath the sewing material, the advance wheel and roller positioned to selectively engage the sewing material and advance the sewing material beneath the open notched needle of each of the multiple upper and lower sewing mechanisms, as the open notched needle is moved in a cyclic, reciprocating actuation.

24. The sewing machine apparatus of claim 19, wherein the open notched needle is releasably secured to at least one of the multiple upper sewing mechanisms, and the open notched needle has a small radius inwardly curved from the surface of the needle shank into an upper interior line of the notch, a smooth enlargement of a cross sectional area of the needle shank around the notch, and a straight line slope of a lower interior portion of the notch, with an arcuate portion tangent to a distal portion of the needle.

25. A sewing machine apparatus for sewing large widths of material, comprising:

a) an upper sewing mechanism secured to an upper support means, the upper sewing mechanism having a cyclic, reciprocating actuation means, the cyclic, reciprocating actuation means adapted to raise an open notched needle above the sewing material in a substantially raised position, and further adapted to move the notched needle to penetrate the sewing material in a substantially lowered position;

b) the notched needle having a shank with a needle end, and a raised notch opening positioned near the needle end; the raised notched opening on the shank positioned to receive a portion of needle thread therein, and to thrust the needle thread beneath the sewing material on a downward stroke of the notched needle, whereupon the needle thread is released to form a loop beneath the sewing material as the notched needle is raised above the sewing material on an upward stroke of the notched needle;

c) a lower sewing mechanism having a sensing means located beneath the sewing material, for sensing a precise position of the notched needle during its cyclic, reciprocating actuation, the lower sewing mechanism secured to a table support means;

d) a bobbin assembly located in the lower sewing mechanism, the bobbin assembly having a thread take-up and tensioning means responsive to the sensing means for selectively enlarging a last stitch while taking up and tensioning a needle thread loop of a previous stitch;

e) the upper sewing mechanism having a notch threader with two forks positioned to at least partially straddle the notched needle and to bias the needle thread against the needle shaft as the notched needle moves downwardly during each cyclic, reciprocating actuation;

f) a thread nozzle positioned to orient the needle thread across the two forks located on the notch threader;

g) at least one material advancing wheel positioned above the sewing material, and at least one roller positioned beneath the sewing material, the advance wheel and roller positioned to engage and selectively advance the sewing material beneath the open notched needle, as the open notched needle is moved in a cyclic, reciprocating actuation.

26. The sewing machine apparatus of claim 25, wherein a timing function of the lower sewing machine mechanism in relation to the upper sewing machine mechanism, is accomplished through the sewing material.

27. The sewing machine apparatus of claim 25, wherein the lower sewing mechanism is rotated in relation to the upper sewing mechanism about the open notched needle path, to selectively produce a specific type of sewing stitch selected from a lock stitch and a chain stitch.

* * * * *